US008807197B2

(12) United States Patent
Branagan et al.

(10) Patent No.: US 8,807,197 B2
(45) Date of Patent: Aug. 19, 2014

(54) UTILIZATION OF CARBON DIOXIDE AND/OR CARBON MONOXIDE GASES IN PROCESSING METALLIC GLASS COMPOSITIONS

(75) Inventors: Daniel James Branagan, Idaho Falls, ID (US); Brian E. Meacham, Idaho Falls, ID (US); Jason K. Walleser, Idaho Falls, ID (US); Jikou Zhou, Pleasanton, CA (US); Alla V. Sergueeva, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 53 days.

(21) Appl. No.: 13/019,041

(22) Filed: Feb. 1, 2011

(65) Prior Publication Data

US 2011/0186259 A1 Aug. 4, 2011

Related U.S. Application Data

(60) Provisional application No. 61/300,648, filed on Feb. 2, 2010.

(51) Int. Cl.

| | |
|---|---|
| ***B22D 23/00*** | (2006.01) |
| ***B22D 13/00*** | (2006.01) |
| ***B22D 11/00*** | (2006.01) |
| ***C22C 45/02*** | (2006.01) |
| ***C22C 33/00*** | (2006.01) |

(52) U.S. Cl.

CPC ..... *C22C 45/02* (2013.01); *C22C 33/003* (2013.01)

USPC ..... 164/66.1; 164/114; 164/463

(58) Field of Classification Search

USPC ..... 164/47, 114, 66.1, 423, 429, 463, 482; 148/304, 538, 540, 541

See application file for complete search history.

(56) References Cited

U.S. PATENT DOCUMENTS

| | | | | |
|---|---|---|---|---|
| 2,963,364 | A | 12/1960 | Crockett et al. | |
| 3,205,566 | A | 9/1965 | Breton | |
| 4,067,732 | A * | 1/1978 | Ray | 148/403 |
| 4,142,571 | A * | 3/1979 | Narasimhan | 164/463 |
| 4,473,401 | A | 9/1984 | Masumoto et al. | |
| 4,568,389 | A | 2/1986 | Torobin | |
| 4,588,015 | A * | 5/1986 | Liebermann | 164/463 |
| 5,833,769 | A * | 11/1998 | Kogiku et al. | 148/304 |
| 6,306,786 | B1 | 10/2001 | Koyama et al. | |
| 2006/0213586 | A1 | 9/2006 | Kui | |
| 2010/0065163 | A1 * | 3/2010 | Branagan et al. | 148/561 |

FOREIGN PATENT DOCUMENTS

WO WO 9632518 A1 * 10/1996

OTHER PUBLICATIONS

International Search Report and Written Opinion dated Mar. 16, 2011 issued in related International Patent Application No. PCT/US2011023363.

Klement, "Non-crystalline Structure in Solidified Gold-Silicon Alloys," Nature 187 (1960), 869-870.

(Continued)

*Primary Examiner* — Kevin P Kerns
*Assistant Examiner* — Steven Ha
(74) *Attorney, Agent, or Firm* — Grossman, Tucker, Perreault & Pfleger, PLLC

(57) ABSTRACT

A method of forming an iron based glass forming alloy. The method may include providing a feedstock of an iron based glass forming alloy, melting the feedstock, casting the feedstock into an elongated body in an environment comprising 50% or more of a gas selected from carbon dioxide, carbon monoxide or mixtures thereof.

19 Claims, 7 Drawing Sheets

(56) References Cited

OTHER PUBLICATIONS

Johnson, "Bulk Glass-Forming Metallic Alloys: Science and Technology," MRS Bull. 24 (1999), 42-56.
Inoue, "Stabilization of Metallic Supercooled Liquid and Bulk Amorphous Alloys," Acta mater. 48 (2000) 279-306.
Steif, "Strain Localization in Amorphous Metals," Acta Metall. 30 (1982), 447-455.
Chen, "Deformation-induced nanocrystal formation in shear bands of amorphous alloys," Nature 367 (1994), 541-543.
Flores, "Local heating associated with crack tip plasticity in Zr—Ti—Ni—Cu—Be bulk amorphous metals," J. Mater. Res., vol. 14, No. 3, Mar. 1999, p. 638-643.
Hays, "Microstructure Controlled Shear Band Pattern Formation and Enhanced Plasticity of Bulk Metallic Glasses Containing in situ Formed Ductile Phase Dendrite Dispersions," Phys. Rev. Lett. 84 (2000), 2901-2904.
Yim, "Bulk metallic glass matrix composites," Appl. Phys. Lett. 71 (1997), 3808-3810.
Kato et al., "Synthesis and Mechanical Properties of Bulk Amorphous Zr—Al—Ni—Cu Alloys Containing ZrC Particles," Material Translations Online vol. 38 No. 09 (1997) (1 page).
Szuecs, "Mechanical Properties of Zr56.2 Ti13.8 Nb5.0 Cu6.9 Ni5.6 Be12.5 Ductile Phase Reinforced Bulk Metallic Glass Composite," Acta Mater. 49 (2001) 1507-1513.
Yavari, "FeNiB-based metallic glasses with fcc crystallisation products," Journal of Non-Crystalline Solids 304 (2002) 44-50.
Fan,"Metallic glass matrix composite with precipitated ductile reinforcement," Appl. Phys. Lett. 81 (2002) 1020-1022.
Lee, "Effect of a controlled volume fraction of dendritic phases on tensile and compressive ductility in La-based metallic glass matrix composites," Acta Materialia 52 (2004) 4121-4131.
Wada, "Enhancement of room-temperature plasticity in a bulk metallic glass by finely dispersed porosity," Applied Physics Letters 86, 251907 (2005).
Fan, "Ductility of bulk nanocrystalline composites and metallic glasses at room temperature," Appl. Phys. Lett. 77 (2000) 46-48.
Kim, "Role of nanometer-scale quasicrystals in improving the mechanical behavior of Ti-based bulk metallic glasses," Appl. Phys. Lett. 83 (2003) 3093-3095.
Das, "'Work-Hardenable' Ductile Bulk Metallic Glass," Phys. Rev. Lett. 94 (2005) 205501 (4 Pages).
Kim, "Heterogeneity of a CU47.5Zr47.5Al5 bulk metallic glass" Applied Physics Letters 88, 051911 (2006) (3 Pages).
Yao, "Superductile bulk metallic glass," Applied Physics Letters 88, 122106 (2006) (3 Pages).
Kim, "Work hardening ability of ductile Ti45Cu40Ni7.5Zr5Sn2.5 and CU47.5Zr47.5Al5 bulk metallic glasses," Applied Physics Letters 89, 071908 (2006) (3 Pages).
Chen, "Free-volume-induced enhancement of plasticity in a monolithic bulk metallic glass at room temperature," Scripta Materialia 59 (2008) 75-78.
Hofmann, "Designing metallic glass matrix composites with high toughness and tensile ductility," Nature 451 (2008) 1085 (6 pages).
Long, et al., "On the new criterion to assess the glass-forming ability of metallic alloys," Materials Science and Engineering A 509 (2009) 23-30.
Selines, et al., "Selection of Stirring and Shrouding Gases for Steelmaking Applications," Union Carbide Corp. 1988.

* cited by examiner

UTILIZATION OF CARBON DIOXIDE AND/OR CARBON MONOXIDE GASES IN PROCESSING METALLIC GLASS COMPOSITIONS

CROSS-REFERENCE TO RELATED APPLICATIONS

This application claims the benefit of U.S. Provisional Patent Application Ser. No. 61/300,648, filed on Feb. 2, 2010, which is fully incorporated herein by reference.

FIELD

This application relates to the use of carbon dioxide and/or carbon monoxide gases in processing iron based glass forming alloys, which may be applied to a variety of rapid solidification processing methods.

BACKGROUND

Amorphous metallic alloys (i.e., metallic glasses) represent a relatively young class of materials, having been first reported around 1960 when classic rapid-quenching experiments were performed on Au—Si alloys. Since that time, there has been progress in exploring alloys compositions for glass formers, seeking elemental combinations with ever-lower critical cooling rates, which may still retain an amorphous structure. Due to the absence of long-range order, metallic glasses may exhibit relatively unique properties, such as high strength, high hardness, large elastic limit, good soft magnetic properties and high corrosion resistance. However, owing to strain softening and/or thermal softening, plastic deformation of metallic glasses may be highly localized into shear bands, which may result in a limited plastic strain (e.g., less than 2%) and failure at room temperature.

Different approaches have been applied to enhance ductility of metallic glasses including: introducing heterogeneities such as micrometer-sized crystallites, or a distribution of porosities, forming nanometer-sized crystallites, glassy phase separation, or by introducing free volume in amorphous structure. The heterogeneous structure of these composites may act as an initiation site for the formation of shear bands and/or a barrier to the rapid propagation of shear bands, which may result in a relative enhancement of global plasticity, but may sometimes decrease strength. It should be noted, that while some metallic glasses may exhibit relatively enhanced plasticity during compression tests (12-15%), their response in unconstrained loading may be much different and the tensile elongation may not exceed 2%.

Relatively recent results on improvement of tensile ductility of metallic glasses indicated that 13% tensile elongation may be achieved in zirconium based alloys with large dendrites (20-50 μm in size) embedded in a glassy matrix. It should be noted that this material is primarily crystalline exhibiting 50% or greater crystallinity by volume and might be considered a microcrystalline alloy with a residual amorphous phase along dendrite boundaries. Furthermore, the maximum strength of these alloys may be relatively low at 1.5 GPa and ductility may only be achieved after the yield point is exceeded, resulting in strain softening which may not be considered industrially usable. Thus, while metallic glasses are known to exhibit somewhat favorable characteristics including relatively high strength and high elastic limit, their ability to deform in tension may be limited, which may limit the industrial utilization of this class of materials.

SUMMARY

An aspect of the present disclosure relates to a method of forming an iron based glass forming alloy. The method may include providing a feedstock of an iron based glass forming alloy, melting the feedstock, casting the feedstock into an elongated body in an environment comprising 50% or more of a gas selected from carbon dioxide, carbon monoxide or mixtures thereof.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
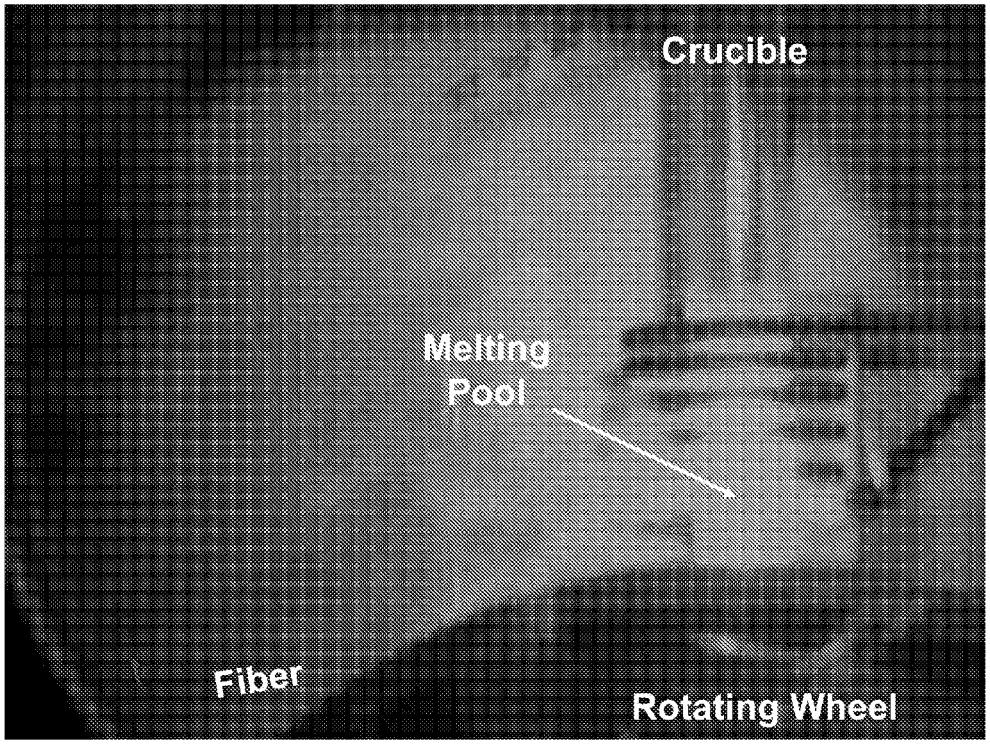
FIG. 1 illustrates an image frame extracted from a video that records the melt-spinning process carried out in air at one third atmosphere pressure.

Metallic glasses may be produced through a variety of quick-cooling methods, wherein rapid cooling may be too fast for crystals to form and the material is "locked in" a glassy state. Recent achievements related to the understanding of glass formation and increasing glass forming ability of a number of different alloys have resulted in a decrease in critical cooling rate for glass formation to relatively low values. One parameter believed to be important is gas atmosphere during processing since the atmosphere may be considered key to enabling the formation of a metallic glass. One key in avoiding nucleation during solidification is to avoid heterogeneous nucleation sites which, once formed, may lead to rapid nucleation since the liquid melt may be in a supercooled condition with high driving force. Oxides, nitrides etc. can often form if an inert atmosphere is not utilized, often destroying or reducing the ability to form a metallic glass. Common gases to process glass forming alloys include inert atmosphere gases such as helium, argon and nitrogen at various partial pressures from full atmosphere (i.e. 1 atm) to low partial pressures/full vacuum. Inert gases such as argon and helium have been used to protect molten metal surfaces or streams during processing and may be relatively expensive compared to other gasses. Nitrogen gas is presently used when the nitride content may not be a critical specification of the finished product but it may be limited in iron based glass forming systems due to the relatively high solubility of nitrogen in molten iron and nitride formation. Accordingly, it may be appreciated that the use of relatively cheaper gases or more abundant gases without substantial detriment to the properties of a composition may be useful in lab scale as well as industrial processing of metallic glass compositions.

The present application utilizes carbon dioxide, carbon monoxide or mixtures thereof in the processing of glass forming chemistries which may lead to Spinodal Glass Matrix Microconstituent (SGMM) structures that may exhibit relatively significant ductility and relatively high tensile strength. Spinodal microconstituents may be understood as microconstituents formed by a transformation mechanism which is not nucleation controlled. More basically, spinodal decomposition may be understood as a mechanism by which a solution of two or more components (e.g. metal compositions) of the alloy can separate into distinct regions (or phases) with distinctly different chemical compositions and physical properties. This mechanism differs from classical nucleation in that phase separation occurs uniformly throughout the material and not just at discrete nucleation sites. One or more semicrystalline clusters or crystalline phases may therefore form through a successive diffusion of atoms on a local level until the chemistry fluctuations lead to at least one distinct crystalline phase. Semi-crystalline clusters may be understood herein as exhibiting a largest linear dimension of 2 nm or less, whereas crystalline clusters may exhibit a largest linear dimension of greater than 2 nm. Note that during the early stages of the spinodal decomposition, the clusters which are formed may be relatively small and while their chemistry differs from the glass matrix, they are not yet fully crystalline and have not yet achieved well ordered crystalline periodicity. Additional crystalline phases may exhibit the same crystal structure or distinct structures. Furthermore the glass matrix may be understood to include microstructures that may exhibit associations of structural units in the solid phase that may be randomly packed together. The level of refinement, or the size, of the structural units may be in the angstrom scale range (i.e. 5 Å to 100 Å). Glass may be present at 15% or greater by volume, including all values and increments in the range of 15% to 90% by volume, at 0.1% increments.

In addition, the alloys may exhibit Induced Shear Band Blunting (ISBB) and Induced Shear Band Arresting (ISBA) which may be enabled by the spinodal glass matrix microconstituent (SGMM). While conventional materials may deform through dislocations moving on specific slip systems in crystalline metals, the mechanism effective herein may involve moving shear bands (i.e., discontinuities where localized deformation occurs) in a spinodal glass matrix microconstituent which are blunted by localized deformation induced changes (LDIC) described further below. With increasing levels of stress, once a shear band is blunted, new shear bands may be nucleated and then interact with existing shear bands creating relatively high shear band densities in tension and the development of relatively significant levels of global plasticity. Thus, the alloys with favorable SGMM structures may prevent or mitigate shear band propagation in tension, which may result in relatively significant tensile ductility (>1%) and lead to strain hardening during tensile testing. The alloys contemplated herein may include or consist of chemistries capable of forming a spinodal glass matrix microconstituent, wherein the spinodal glass matrix microconstituents may be present in the range of 5 to 95% by volume.

The glass forming chemistries contemplated herein, which may lead to Spinodal Glass Matrix Microconstituent structures, may include iron based glass forming alloys. The iron based glass forming alloys may include iron present in the range of 40.50 to 65.60 atomic percent, nickel present in the range of 13.00 to 17.50 atomic percent, cobalt present in the range of 2.00 to 21.50 atomic percent, boron present in the range of 11.50 to 17.00 atomic percent, carbon optionally present in the range of 4.00 to 5.00 atomic percent or 7.00 to 8.00 atomic percent, silicon optionally present in the range of 0.30 to 4.50 atomic percent and chromium optionally present in the range of 2.00 to 20.50 atomic percent. It may be appreciated that the elemental constituents of the iron based glass compositions may be present at a total of 100 atomic percent. The iron based glass forming alloy may also include up to 5.00 atomic percent impurities, which may be introduced in through the individual alloy components or introduced during alloy formation.

It may also be appreciated that the elemental constituents may be present at any value or increment in the ranges recited above. For example, iron may be at 40.5, 40.6, 40.7, 40.8, 40.9, 41.0, 41.1, 41.2, 41.3, 41.4, 41.5, 41.6, 41.7, 41.8, 41.9, 42.0, 42.1, 42.2, 42.3, 42.4, 42.5, 42.6, 42.7, 42.8, 42.9, 43.0, 43.1, 43.2, 43.3, 43.4, 43.5, 43.6, 43.7, 43.8, 43.9, 44.0, 44.1, 44.2, 44.3, 44.4, 44.5, 44.6, 44.7, 44.8, 44.9, 45.0, 45.1, 45.2, 45.3, 45.4, 45.5, 45.6, 45.7, 45.8, 45.9, 46.0, 46.1, 46.2, 46.3, 46.4, 46.5, 46.6, 46.7, 46.8, 46.9, 47.0, 47.1, 47.2, 47.3, 47.4, 47.5, 47.6, 47.7, 47.8, 47.9, 48.0, 48.1, 48.2, 48.3, 48.4, 48.5, 48.6, 48.7, 48.8, 48.9, 49.0, 49.1, 49.2, 49.3, 49.4, 49.5, 49.6, 49.7, 49.8, 49.9, 50.0, 50.1, 50.2, 50.3, 50.4, 50.5, 50.6, 50.7, 50.8, 50.9, 51.0, 51.1, 51.2, 51.3, 51.4, 51.5, 51.6, 51.7, 51.8, 51.9, 52.0, 52.1, 52.2, 52.3, 52.4, 52.5, 52.6, 52.7, 52.8, 52.9, 53.0, 53.1, 53.2, 53.3, 53.4, 53.5, 53.6, 53.7, 53.8, 53.9, 54.0, 54.1, 54.2, 54.3, 54.4, 54.5, 54.6, 54.7, 54.8, 54.9, 55.0, 55.1, 55.2, 55.3, 55.4, 55.5, 55.6, 55.7, 55.8, 55.9, 56.0, 56.1, 56.2, 56.3, 56.4, 56.5, 56.6, 56.7, 56.8, 56.9, 57.0, 57.1, 57.2, 57.3, 57.4, 57.5, 57.6, 57.7, 57.8, 57.9, 58.0, 58.1, 58.2, 58.3, 58.4, 58.5, 58.6, 58.7, 58.8, 58.9, 59.0, 59.1, 59.2, 59.3, 59.4, 59.5, 59.6, 59.7, 59.8, 59.9, 60.0, 60.1, 60.2, 60.3, 60.4, 60.5, 60.6, 60.7, 60.8, 60.9, 61.0, 61.1, 61.2, 61.3, 61.4, 61.5, 61.6, 61.7, 61.8, 61.9, 62.0, 62.1, 62.2, 62.3, 62.4, 62.5, 62.6, 62.7, 62.8, 62.9, 63.0, 63.1, 63.2, 63.3, 63.4, 63.5, 63.6, 63.7, 63.8, 63.9, 64.0, 64.1, 64.2, 64.3, 64.4, 64.5, 64.6, 64.7, 64.8, 64.9, 65.0, 65.1, 65.2, 65.3, 65.4, 65.5 atomic percent, as well as 0.01 increments thereof. Nickel may be present at 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0, 16.1, 16.2, 16.3, 16.4, 16.5, 16.6, 16.7, 16.8, 16.9, 17.0, 17.1, 17.2, 17.3, 17.4, 17.5 atomic percent, as well as 0.01 increments thereof. Cobalt may be present at 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0, 16.1, 16.2, 16.3, 16.4, 16.5, 16.6, 16.7, 16.8, 16.9, 17.0, 17.1, 17.2, 17.3, 17.4, 17.5, 17.6, 17.7, 17.8, 17.9, 18.0, 18.1, 18.2, 18.3, 18.4, 18.5, 18.6, 18.7, 18.8, 18.9, 19.0, 19.1, 19.2, 19.3, 19.4, 19.5, 19.6, 19.7, 19.8, 19.9, 20.0, 20.1, 20.2, 20.3, 20.4, 20.5, 20.6, 20.7, 20.8, 20.9, 21.0, 21.1, 21.2, 21.3, 21.4, 21.5 atomic percent, as well as 0.01 increments thereof. Boron may be present at 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0, 16.1, 16.2, 16.3, 16.4, 16.5, 16.6, 16.7, 16.8, 16.9, 17.0 atomic percent, as well as 0.01 increments thereof. Carbon may be present at 0, 4.0, 4.1, 4.2, 4.3, 4.4, 4.5, 4.6, 4.7, 4.8, 4.9, 5.0, 7.0, 7.1, 7.2, 7.3, 7.4, 7.5, 7.6, 7.7, 7.8, 7.9, 8.0 atomic percent, as well as 0.01 increments thereof. Silicon may be present at 0.0, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5 atomic percent, as well as 0.01 increments thereof. Chromium may be present at 0.0, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0, 16.1, 16.2, 16.3, 16.4, 16.5, 16.6, 16.7, 16.8, 16.9, 17.0, 17.1, 17.2, 17.3, 17.4, 17.5, 17.6, 17.7, 17.8, 17.9, 18.0, 18.1, 18.2, 18.3, 18.4, 18.5, 18.6, 18.7, 18.8, 18.9, 19.0, 19.1, 19.2, 19.3, 19.4, 19.5, 19.6, 19.7, 19.8, 19.9, 20.0, 20.1, 20.2, 20.3, 20.4, 20.5 atomic percent, as well as 0.01 increments thereof.

The alloys may be formulated utilizing commercial purity, high purity or ultra high purity feedstocks. The feedstocks may be melted and formed into an ingot using a shielding gas, such as high purity argon, helium or nitrogen shielding gas. The ingots may then be flipped and re-melted several times into ingots to improve homogeneity. The ingots may then be formed into a form or elongated body such as wire or ribbon using a number of casting processes such as melt spinning, jet casting, hyperquenching, planar flow casting, and twin roll casting at thicknesses down to a few microns and up to a few millimeters and widths from 0.1 mm up to several thousand mm. For example, thicknesses may be in the range of 2 microns to 10 millimeters, including all values and increments therein, and widths may be in the range of 0.1 mm to 10,000 mm, including all values and increments therein.

Casting may be performed in an environment including, consisting essentially of, or consisting of $CO_x$, wherein x is 1 (carbon monoxide), 2 (carbon dioxide) or mixtures thereof. The $CO_x$ may be present with other gasses, including inert gases such as argon, nitrogen, etc., or atmospheric gases, i.e., air. The $CO_x$ may be present at 50% or more by total volume, including all values and ranges from 50% to 100%, such as 75%, 80%, 90%, 95%, 99%, etc.

In cases where mixtures of $CO_x$ may be present, carbon dioxide may be present in the mixture in the range of 1% to 99%, including all values and ranges therein and carbon monoxide may be present in the mixture in the range of 99% to 1%, including all values and ranges therein. For example, the $CO_x$ in the environment may include a 50/50 mixture of carbon dioxide to carbon monoxide, a 30/70 mixture of carbon dioxide to carbon monoxide or a 60/40 mixture of carbon dioxide to carbon monoxide. The gas may be present at a pressure in the range of 0.1 to 1 atmosphere (atm), including all values and increments therein, such as 0.33 atm, 0.5 atm, 0.67 atm, etc.

Once formed, or cast, the alloys may exhibit one or more glass to crystalline transformations in the range of 400° C. to 552° C. as tested via differential thermal analysis (DTA) or differential scanning calorimetry (DSC) at a rate of 10° C./min, including all values and increments therein. The enthalpies may range from 62.7 J/g to 143.6 J/g and the testing may be performed under ultra high purity argon. Primary glass to crystalline onset temperatures may range from 400° C. to 517° C., including all values and increments therein and primary glass to crystalline peak temperatures may range from 416.9° C. to 527° C., including all values and increments therein. Secondary glass to crystalline onset temperatures may range from 469.3° C. to 533.0° C., including all values and increments therein and secondary glass to crystalline peak temperatures may range from 476.2° C. to 552° C., including all values and increments therein.

In addition, the alloys may be bendable, such that they may be bent flat (i.e., 180°), regardless of the side of the ribbon that may have contacted a casting surface during formation. The iron based glass forming alloys may also exhibit the following mechanical properties when tested at a strain rate of 0.001 $s^{-1}$. The elongation may be in the range of 2.10% to 4.23%, including all values and increments therein. The ultimate tensile strength may be in the range of 1.55 GPa to 3.30 GPa, including all values and increments therein. The Young's Modulus may be in the range of 103.7 GPa to 230.7 GPa, including all values and increments therein. The above mechanical properties may be exhibited by the formed iron based glass forming alloy alone or in combination.

It may be appreciated that the mechanical properties of the iron based glass forming alloys formed in the carbon dioxide, carbon monoxide or mixtures thereof may be relatively similar to those produced using other inert environments, as demonstrated more fully by the examples below. In some cases, as illustrated below, it would appear that the use of a carbon monoxide/carbon dioxide mixture may also increase the onset and peak glass to crystalline temperatures as well as increasing the enthalpy. It may also be appreciated the use of carbon dioxide, carbon monoxide and mixtures thereof in the forming iron based glass forming alloys capable of developing spinodal glass forming matrix may reduce the process costs of the alloy compositions.

In addition, even though it would appear that the use of carbon dioxide with molten iron based glass forming alloys would lead to deleterious oxides, carbides, etc., which may lead to nucleation sites destroying the ability to form a metallic glass structure and reducing the glass volume to less than 15%, this does not appear to be the case with the alloy compositions contemplated herein. However, this may not be true for other glass forming alloy compositions, such as Nd—Fe—B. Further, it is contemplated that during the casting process the employment of a carbon monoxide, carbon dioxide or mixture thereof, may improve coupling of the liquid melt of the glass forming iron alloy to the casting surface(s), thereby increasing the cooling rate of the alloy as suggested by the examples below.

While, in the present disclosure, the demonstration of processing in carbon dioxide, carbon monoxide or mixtures thereof has been performed utilizing laboratory scale melt-spinning, it is anticipated that the advantages shown of using the new gas/mixtures would be important for any process whereby a liquid melt is cooled onto a chill surface. Example processes other than laboratory scale melt-spinning include jet casting, hyperquenching, planar flow casting, and twin roll casting at thicknesses down to a few microns and up to a few millimeters and widths from 0.1 mm up to several thousand mm, such as up to 2,000 mm.

EXAMPLES

The following examples are presented for the purposes of illustration and are not meant to be limiting of the description herein or the claims appended hereto.

Sample Preparation Using high purity elements, 15 g alloy feedstocks of examples of the iron based glass forming alloys, which may lead to SGMM structures, contemplated herein were weighed out according to the atomic ratios provided in Table 1. The feedstock material for each alloy was then placed into the copper hearth of an arc-melting system. The feedstock was arc-melted into an ingot using high purity argon as a shielding gas. The ingots were flipped several times and re-melted to ensure homogeneity. After mixing, the ingots were then cast in the form of a finger approximately 12 mm wide by 30 mm long and 8 mm thick. The ingots were processed by melt spinning in a $CO_2$ environment under the process conditions shown in Table 2. Note that during the melt-spinning process, the ingot may be contained in a quartz crucible with a hole diameter which may be in the range 0.81 to 0.84 mm. The ejection pressures shown in Table 2 were used to eject the liquid melt through the hole in the crucible and onto the rapidly moving copper wheel with a diameter of 250 mm at the ejection temperature shown in Table 2.

TABLE 1

Atomic Ratio's for Alloys

| Alloy | Fe | Ni | Co | B | C | Si | Cr |
|---|---|---|---|---|---|---|---|
| 1 | 53.50 | 15.50 | 10.00 | 16.00 | 4.50 | 0.50 | 0.00 |
| 2 | 63.00 | 16.50 | 3.00 | 12.49 | 4.54 | 0.47 | 0.00 |
| 3 | 43.55 | 16.50 | 21.00 | 16.49 | 0.00 | 2.46 | 0.00 |
| 4 | 65.03 | 16.50 | 3.00 | 15.00 | 0.00 | 0.47 | 0.00 |
| 5 | 51.01 | 16.50 | 12.00 | 16.49 | 0.00 | 4.00 | 0.00 |
| 6 | 63.08 | 16.01 | 2.91 | 14.55 | 0.00 | 0.45 | 3.00 |
| 7 | 60.48 | 15.34 | 2.79 | 13.95 | 0.00 | 0.44 | 7.00 |
| 8 | 52.02 | 13.20 | 2.40 | 12.00 | 0.00 | 0.38 | 20.00 |
| 9 | 49.48 | 16.01 | 11.64 | 16.00 | 0.00 | 3.87 | 3.00 |
| 10 | 45.91 | 14.85 | 10.80 | 14.84 | 0.00 | 3.60 | 10.00 |
| 11 | 40.81 | 13.20 | 9.60 | 13.19 | 0.00 | 3.20 | 20.00 |
| 12 | 57.34 | 17.02 | 5.00 | 14.16 | 0.00 | 3.76 | 2.72 |
| 13 | 57.18 | 14.52 | 2.64 | 13.19 | 7.76 | 2.00 | 2.71 |
| 14 | 49.82 | 14.52 | 12.00 | 13.19 | 7.76 | 0.00 | 2.71 |
| 15 | 44.54 | 16.50 | 12.00 | 16.49 | 7.76 | 0.00 | 2.71 |

TABLE 2

Process Parameter List

| MS | Chamber gas | Pressure in chamber [mbar] | Pressure in ballast [torr] | Wheel Speed [m/s] | Crucible-chill gap [mm] | Ejection Pressure [mbar] | Ejection Temperature [° C.] |
|---|---|---|---|---|---|---|---|
| 62 | $CO_2$ | 340 | 465 | 25 | 5 | 280 | 1250 |

As-Solidified Structure Thermal analysis was performed on the as-solidified ribbons using a Perkin Elmer DTA-7 system with the DSC-7 option. Differential thermal analysis (DTA) and differential scanning calorimetry (DSC) was performed at a heating rate of 10° C./minute with samples protected from oxidation through the use of flowing ultrahigh purity argon. In Table 3, the DSC data relating to the glass to crystalline transformation is shown for the alloys that have been melt-spun using the MS62 melt-spinning process parameters. All of the samples were found to contain a fraction of glass 15% or greater by volume. In these ribbons, the glass to crystalline transformation occurs in one or two stages in the range of temperature from 400 to 552° C. and with combined enthalpies of transformation from 62.7 to 143.6 J/g.

TABLE 3

DTA Data

| Alloy | Melt Spinning Parameter | Glass Present | Peak #1 Onset [° C.] | Peak #1 Temp [° C.] | Peak #1 −ΔH [J/g] | Peak #2 Onset [° C.] | Peak #2 Temp [° C.] | Peak #2 −ΔH [J/g] |
|---|---|---|---|---|---|---|---|---|
| 1 | MS62 | Yes | 467.2 | 472.2 | 95.6 | — | — | — |
| 2 | MS62 | Yes | 429.8 | 441.1 | 27.0 | 472.5 | 477.3 | 54.4 |
| 3 | MS62 | Yes | 466.0 | 478.6 | 46.6 | 498.7 | 504.5 | 75.5 |

TABLE 3-continued

DTA Data

| Alloy | Melt Spinning Parameter | Glass Present | Peak #1 Onset [° C.] | Peak #1 Temp [° C.] | Peak #1 −ΔH [J/g] | Peak #2 Onset [° C.] | Peak #2 Temp [° C.] | Peak #2 −ΔH [J/g] |
|---|---|---|---|---|---|---|---|---|
| 4 | MS62 | Yes | 420.7 | 433.8 | 43.8 | 469.3 | 476.2 | 71.6 |
| 5 | MS62 | Yes | 480.5 | 486.5 | — | — | 501.2 | 103.6* |
| 6 | MS62 | Yes | 406.1 | 419.4 | 28.2 | 474.8 | 480.9 | 34.5 |
| 7 | MS62 | Yes | 400.1 | 416.9 | 43.2 | 479.3 | 492.8 | 64.9 |
| 8 | MS62 | Yes | 425.6 | 449.7 | 50.9 | 533.0 | 545.1 | 50.8 |
| 9 | MS62 | Yes | 482.5 | 488.3 | 71.4 | — | — | — |
| 10 | MS62 | Yes | 425.5 | 441.3 | 59.6 | 520.7 | 530.3 | 41.1 |
| 11 | MS62 | Yes | 447.8 | 466.1 | 57.6 | 541.2 | 551.5 | 45.1 |
| 12 | MS62 | Yes | 444.7 | 456.4 | 59.2 | 499.2 | 506.2 | 84.4 |
| 13 | MS62 | Yes | 500.8 | 521.6 | 108.1 | — | — | — |
| 14 | MS62 | Yes | 486 | 498 | 51 | 531 | 534 | 74 |
| 15 | MS62 | Yes | 517 | 527 | 108 | — | — | — |

*Overlapping peak

Bendability Response The ability of the ribbons to bend completely flat may indicate a ductile condition whereby relatively high strain may be obtained but not measured by traditional bend testing. When the ribbons are folded completely around themselves, they may experience strain which can be as high as 119.8% as derived from complex mechanics. In practice, the strain may be in the range of ~57% to ~97% strain in the tension side of the ribbon. During 180° bending (i.e. flat), four types of behavior were observed; Type 1 Behavior—not bendable without breaking, Type 2 Behavior—bendable on one side with wheel side out, Type 3 Behavior—bendable on one side with free side out, and Type 4 Behavior—bendable on both sides. Reference to "wheel side" may be understood as the side of the ribbon which contacted the wheel during melting spinning. In Table 4, a summary of the 180° bending results including the specific behavior type are shown for the studied alloys.

TABLE 4

Bend Testing Results

| Alloy | Melt-Spinning Parameter | Density [g/cm$^3$] | Thickness [μm] | Bend Ability Type |
|---|---|---|---|---|
| 1 | MS62 | 7.718 | 36-39 | 4 |
| 2 | MS62 | 7.799 | 35-38 | 4 |
| 3 | MS62 | 7.813 | 36-37 | 4 |
| 4 | MS62 | 7.738 | 35-38 | 4 |
| 5 | MS62 | 7.648 | 39-40 | 4 |
| 6 | MS62 | 7.765 | 34-37 | 4 |
| 7 | MS62 | 7.745 | 32-37 | 4 |
| 8 | MS62 | 7.655 | 39-40 | 4 |
| 9 | MS62 | 7.701 | 38-39 | 4 |
| 10 | MS62 | 7.661 | 33-34 | 4 |
| 11 | MS62 | 7.549 | 32-33 | 4 |
| 12 | MS62 | 7.712 | 34-38 | 4 |

TABLE 4-continued

| Bend Testing Results | | | | |
|---|---|---|---|---|
| Alloy | Melt-Spinning Parameter | Density [g/cm$^3$] | Thickness [μm] | Bend Ability Type |
| 13 | MS62 | 7.544 | 33-34 | 4 |
| 14 | MS62 | 7.667 | 42-44 | 4 |
| 15 | MS62 | 7.515 | 40-42 | 4 |

Tensile Test Results The mechanical properties of metallic ribbons were obtained at room temperature using microscale tensile testing. The testing was carried out in a commercial tensile stage made by Fullam which was monitored and controlled by a MTEST Windows software program. The deformation was applied by a stepping motor through the gripping system while the load was measured by a load cell that was connected to the end of one gripping jaw. Displacement was obtained using a Linear Variable Differential Transformer (LVDT) which was attached to the two gripping jaws to measure the change of gage length. Before testing, the thickness and width of a ribbon were carefully measured for at least three times at different locations in the gage length. The average values were then recorded as gage thickness and width, and used as input parameters for subsequent stress and strain calculation. All tests were performed under displacement control, with a strain rate of ~0.001 $s^{-1}$.

In Table 5, a summary of the tensile test results including gage dimensions, elongation, breaking load, yield stress, ultimate strength and Young's Modulus are shown for each alloy of Table 1. Note that each distinct sample was measured in triplicate since occasional macrodefects arising from the melt-spinning process can lead to localized stresses reducing properties. For fibers processed in $CO_2$, the total elongation values vary from 2.10 to 4.23% with high tensile strength values from 2.01 to 3.29 GPa. Young's Modulus was found to vary from 103.7 to 230.7 GPa. Note that the results shown in Tables 5 and 6 have been adjusted for machine compliance and geometric cross sectional area.

TABLE 5

| Tensile Property of Fibers Produced in $CO_2$ (MS62) | | | | | | | | |
|---|---|---|---|---|---|---|---|---|
| | Gage Dimensions (mm) | | | Elong. | Break Load | Strength (GPa) | | Young's Modulus |
| Alloy | W | T | L | (%) | (N) | Yield | UTS | (GPa) |
| 1 | 1.37 | 0.037 | 9.00 | 3.51 | 147.9 | 1.33 | 3.11 | 155.0 |
| | 1.38 | 0.039 | 9.00 | 3.96 | 151.4 | 1.10 | 3.00 | 137.3 |
| | 1.36 | 0.036 | 9.00 | 3.24 | 151.3 | 1.60 | 3.29 | 166.0 |
| 2 | 1.42 | 0.035 | 9.00 | 3.60 | 148.2 | 1.25 | 3.16 | 158.2 |
| | 1.41 | 0.038 | 9.00 | 3.51 | 149.3 | 1.08 | 2.95 | 150.3 |
| | 1.41 | 0.037 | 9.00 | 3.15 | 149.7 | 1.06 | 3.04 | 166.5 |
| 3 | 1.40 | 0.037 | 9.00 | 3.30 | 135.6 | 1.06 | 2.77 | 172.7 |
| | 1.41 | 0.037 | 9.00 | 3.10 | 149.5 | 1.12 | 3.04 | 159.8 |
| | 1.41 | 0.037 | 9.00 | 3.70 | 155.5 | 1.53 | 3.16 | 166.7 |
| 4 | 1.30 | 0.035 | 9.00 | 2.70 | 114.9 | 1.20 | 2.69 | 162.2 |
| | 1.24 | 0.038 | 9.00 | 3.10 | 111.4 | 1.07 | 2.52 | 144.7 |
| | 1.29 | 0.037 | 9.00 | 3.00 | 117.9 | 1.22 | 2.63 | 139.8 |
| 5 | 1.28 | 0.039 | 9.00 | 2.90 | 136.8 | 1.07 | 2.92 | 204.0 |
| | 1.29 | 0.040 | 9.00 | 4.00 | 147.9 | 1.19 | 3.05 | 177.8 |
| | 1.27 | 0.040 | 9.00 | 3.00 | 125.9 | 1.07 | 2.64 | 184.6 |

TABLE 5-continued

| Tensile Property of Fibers Produced in $CO_2$ (MS62) | | | | | | | | |
|---|---|---|---|---|---|---|---|---|
| | Gage Dimensions (mm) | | | Elong. | Break Load | Strength (GPa) | | Young's Modulus |
| Alloy | W | T | L | (%) | (N) | Yield | UTS | (GPa) |
| 6 | 1.46 | 0.034 | 9.00 | 3.10 | 131.4 | 1.16 | 2.81 | 179.7 |
| | 1.45 | 0.037 | 9.00 | 3.30 | 131.4 | 1.06 | 2.60 | 150.2 |
| | 1.45 | 0.036 | 9.00 | 3.30 | 133.8 | 1.06 | 2.72 | 173.9 |
| 7 | 1.08 | 0.037 | 9.00 | 2.90 | 80.0 | 1.08 | 2.16 | 127.5 |
| | 1.08 | 0.032 | 9.00 | 3.20 | 88.6 | 1.22 | 2.77 | 158.1 |
| | 1.10 | 0.034 | 9.00 | 2.80 | 88.5 | 1.08 | 2.56 | 161.3 |
| 8 | 1.34 | 0.040 | 9.00 | 2.60 | 141.7 | 1.33 | 2.81 | 201.9 |
| | 1.37 | 0.039 | 9.00 | 2.70 | 139.1 | 1.02 | 2.77 | 190.9 |
| | 1.35 | 0.039 | 9.00 | 3.10 | 134.3 | 1.00 | 2.72 | 173.5 |
| 9 | 1.41 | 0.038 | 9.00 | 3.90 | 154.3 | 1.00 | 3.07 | 174.4 |
| | 1.37 | 0.038 | 9.00 | 2.80 | 140.3 | 1.14 | 2.87 | 195.2 |
| | 1.37 | 0.038 | 9.00 | 2.80 | 133.5 | 1.00 | 2.73 | 190.1 |
| 10 | 0.95 | 0.033 | 9.00 | 2.60 | 83.9 | 1.12 | 2.90 | 177.7 |
| | 0.95 | 0.033 | 9.00 | 2.11 | 69.4 | 1.00 | 2.40 | 187.5 |
| | 0.97 | 0.033 | 9.00 | 2.30 | 85.9 | 1.00 | 2.91 | 211.4 |
| 11 | 0.79 | 0.032 | 9.00 | 2.10 | 58.2 | 1.00 | 2.51 | 175.4 |
| | 0.78 | 0.032 | 9.00 | 2.20 | 59.0 | 1.07 | 2.57 | 190.1 |
| | 0.78 | 0.032 | 9.00 | 2.30 | 49.8 | 1.31 | 2.17 | 151.0 |
| 12 | 1.62 | 0.038 | 9.00 | 2.29 | 112.1 | 1.72 | 2.01 | 156.0 |
| | 1.69 | 0.037 | 9.00 | 3.47 | 166.4 | 1.07 | 2.79 | 159.6 |
| | 1.72 | 0.034 | 9.00 | 2.88 | 134.8 | 1.43 | 2.43 | 147.4 |
| 13 | 1.53 | 0.033 | 9.00 | 2.87 | 151.3 | 1.69 | 3.15 | 230.7 |
| | 1.52 | 0.034 | 9.00 | 3.04 | 147.6 | 1.23 | 3.00 | 172.0 |
| | 1.5 | 0.034 | 9.00 | 2.75 | 138.0 | 1.44 | 2.84 | 174.9 |
| 14 | 1.36 | 0.044 | 9.00 | 3.42 | 135.7 | 1.37 | 2.38 | 157.6 |
| | 1.35 | 0.042 | 9.00 | 2.97 | 137.5 | 1.07 | 2.46 | 119.2 |
| | 1.36 | 0.042 | 9.00 | 3.06 | 138.2 | 1.07 | 2.61 | 153.4 |
| 15 | 1.33 | 0.040 | 9.00 | 4.23 | 134.5 | 1.07 | 2.71 | 103.7 |
| | 1.32 | 0.040 | 9.00 | 2.88 | 126.9 | 1.35 | 2.57 | 150.5 |
| | 1.31 | 0.040 | 9.00 | 3.69 | 140.5 | 1.07 | 2.87 | 140.5 |

Case Example #1

Using high purity elements, 15 g alloy feedstocks of alloys 13 and 14 were weighed out according to the atomic ratios provided in Table 1. The feedstock material was then placed into the copper hearth of an arc-melting system. The feedstock was arc-melted into an ingot using high purity argon as a shielding gas. The ingots were flipped several times and re-melted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were processed in 90% $CO_2$ by volume+10% CO by volume mixed atmosphere at ⅓ atm under process conditions shown in Table 6.

TABLE 6

| Process Parameter List | | | | | | | |
|---|---|---|---|---|---|---|---|
| MS | Chamber gas | Pressure in chamber [mbar] | Pressure in ballast [torr] | Wheel Speed [m/s] | Crucible-chill gap [mm] | Ejection Pressure [mbar] | Ejection Temp. [° C.] |
| 74 | ⅓($CO + CO_2$) | 340 | 465.00 | 25 | 5 | 280 | 1300 |

Thermal analysis was performed on the as-solidified ribbons using a Perkin Elmer DTA-7 system with the DSC-7 option. Differential thermal analysis (DTA) and differential scanning calorimetry (DSC) was performed at a heating rate of 10° C./minute with samples protected from oxidation through the use of flowing ultrahigh purity argon. In Table 7, the DSC data related to the glass to crystalline transformation is shown for the alloys that have been melt-spun using the various melt-spinning process parameters. All of the samples were found to contain a relatively significant fraction of glass of 15% or greater by volume. The glass to crystalline transformation occurs in one stage in alloy 13 and in two stages in alloy 14 in the range of temperature from 486.3 to 531.1° C. and with enthalpies of transformation of 73.5 J/g in alloy 13 and 84.5 J/g in alloy 14.

TABLE 7

| DTA Data | | | | | | | | | |
|---|---|---|---|---|---|---|---|---|---|
| Alloy | Melt Spinning Parameter | Glass Present | Peak #1 Onset [° C.] | Peak #1 Temp [° C.] | Peak #1 −ΔH [J/g] | Peak #2 Onset [° C.] | Peak #2 Temp [° C.] | Peak #2 −ΔH [J/g] |
| 13 | MS74 | Y | 499.4 | 500.2 | 73.5 | — | — | — |
| 14 | MS74 | Y | 486.3 | 496.6 | 35.1 | 517.3 | 531.1 | 49.4 |

The ability of the ribbons to bend completely flat may indicate a ductile condition whereby relatively high strain can be obtained but not measured by traditional bend testing. When the ribbons are folded completely around themselves, they may experience strain which can be as high as 119.8% as derived from complex mechanics. In practice, the strain may be in the range of ~57% to ~97% strain in the tension side of the ribbon. In Table 8, a summary of the 180° bending results including the specific behavior type are shown for the studied alloys and all were found to exhibit Type 4 bending behavior which means that the samples were bendable on both sides, indicating a ductile sample was achieved.

TABLE 8

| Bend Testing Results | | | | |
|---|---|---|---|---|
| Alloy | Melt-Spinning Parameter | Density [g/cm$^3$] | Thickness [μm] | Bend Ability Type |
| 13 | MS74 | 7.640 | 38-40 | 4 |
| 14 | MS74 | 7.173 | 41-44 | 4 |

The mechanical properties of metallic ribbons were obtained at room temperature using microscale tensile testing. The testing was carried out in a commercial tensile stage made by Fullam which was monitored and controlled by a MTEST Windows software program. The deformation was applied by a stepping motor through the gripping system while the load was measured by a load cell that was connected to the end of one gripping jaw. Displacement was obtained using a Linear Variable Differential Transformer (LVDT) which was attached to the two gripping jaws to measure the change of gage length. Before testing, the thickness and width of a ribbon were carefully measured for at least three times at different locations in the gage length. The average values were then recorded as gage thickness and width, and used as input parameters for subsequent stress and strain calculation. All tests were performed under displacement control, with a strain rate of ~0.001 $s^{-1}$.

In Table 9, a summary of the tensile test results including gage dimensions, elongation, breaking load, yield stress, ultimate strength and Young's Modulus are shown for both alloys after processing in ($CO_2$+CO) mixed atmosphere. Note that each distinct sample was measured in triplicate since occasional macrodefects arising from the melt-spinning process can lead to localized stresses reducing properties. As can be seen the total elongation values vary from 2.80 to 3.40% with high tensile strength values from 2.55 to 2.75 GPa. Young's Modulus was found to vary from 147.9 to 183.4 GPa. Note that the results shown in Table 9 have been adjusted for machine compliance and geometric cross sectional area.

TABLE 9

| Tensile Properties of Fibers Produced in ($CO_2$ + CO) Mixed Atmosphere | | | | | | | | |
|---|---|---|---|---|---|---|---|---|
| | Gage Dimensions (mm) | | | Elong. | Break Load | Strength (GPa) | | Young's Modulus |
| Alloy | W | T | L | (%) | (N) | Yield | UTS | (GPa) |
| 13 | 1.61 | 0.040 | 9.00 | 3.40 | 167.7 | 1.00 | 2.75 | 167.0 |
| | 1.63 | 0.038 | 9.00 | 3.20 | 150.5 | 1.09 | 2.56 | 163.6 |
| | 1.60 | 0.040 | 9.00 | 3.40 | 154.5 | 1.12 | 2.55 | 147.9 |
| 14 | 1.40 | 0.043 | 9.00 | 3.20 | 153.4 | 1.05 | 2.71 | 167.2 |
| | 1.41 | 0.043 | 9.00 | 3.20 | 147.4 | 1.04 | 2.59 | 159.8 |
| | 1.40 | 0.043 | 9.00 | 2.80 | 146.1 | 1.40 | 2.59 | 183.4 |

Case Example #2

Using high purity elements, a 15 g alloy feedstock of alloy 14 was weighed out according to the atomic ratios provided in Table 1. The feedstock material was then placed into the copper hearth of an arc-melting system. The feedstock was arc-melted into an ingot using high purity argon as a shielding gas. The ingots were flipped several times and remelted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were processed by melt spinning under the process conditions and atmospheres shown in Table 10.

TABLE 10

| Process Parameter List | | | | | | | |
|---|---|---|---|---|---|---|---|
| MS | Chamber gas | Pressure in chamber [mbar] | Pressure in ballast [torr] | Wheel Speed [m/s] | Crucible-chill gap [mm] | Ejection Pressure [mbar] | Ejection Temp. [° C.] |
| 61 | ⅓He | 340 | 465 | 25 | 5 | 280 | 1300 |
| 62 | ⅓$CO_2$ | 340 | 465 | 25 | 5 | 280 | 1300 |
| 73 | ⅓Ar | 340 | 465 | 25 | 5 | 280 | 1300 |
| 74 | ⅓($CO_2$ + CO) | 340 | 465 | 25 | 5 | 280 | 1300 |

Thermal analysis was performed on the as-solidified ribbons using a Perkin Elmer DTA-7 system with the DSC-7 option. Differential thermal analysis (DTA) and differential scanning calorimetry (DSC) was performed at a heating rate of 10° C./minute with samples protected from oxidation through the use of flowing ultrahigh purity argon. In Table 11, the DSC data related to the glass to crystalline transformation is shown for the alloys that have been melt-spun using the various melt-spinning process parameters. All of the samples were found to contain a significant fraction of glass of 15% or greater by volume. The glass to crystalline transformation occurs in one or two stages in the range of temperature from 486 to 534° C. and with enthalpies of transformation from 73.5 to 125 J/g. The results show that when processing either in the $CO_2$ or mixed $CO_2$+CO atmosphere that high amounts of glass of 15% or greater by volume can be obtained, as evidenced by the similarities in the DTA data, which were in comparable ranges to that achieved in processing in inert gas.

TABLE 11

| DTA Data | | | | | | | |
|---|---|---|---|---|---|---|---|
| Melt Spinning Parameter | Glass Present | Peak #1 Onset [° C.] | Peak #1 Temp [° C.] | Peak #1 −ΔH [J/g] | Peak #2 Onset [° C.] | Peak #2 Temp [° C.] | Peak #2 −ΔH [J/g] |
| 61 | Yes | 486.5 | 497.2 | 34.6 | 517.2 | 530.6 | 47.8 |
| 62 | Yes | 486.0 | 498.0 | 51 | 531.0 | 534.0 | 74 |
| 73 | Yes | 486.0 | 496.5 | 34.7 | 520.5 | 531.0 | 48.2 |
| 74 | Yes | 486.3 | 496.6 | 35.1 | 517.3 | 531.1 | 49.4 |

The ability of the ribbons to bend completely flat may indicate a ductile condition whereby relatively high strain may be obtained but not measured by traditional bend testing. When the ribbons are folded completely around themselves, they may experience strain which can be as high as 119.8% as derived from complex mechanics. In practice, the strain may be in the range of ~57% to ~97% strain in the tension side of the ribbon. In Table 12, a summary of the 180° bending results including the specific behavior type are shown for the studied alloys and all were found to exhibit Type 4 bending behavior which means that the samples were bendable on both sides, indicating a ductile sample was achieved. The results show that when processing either in the $CO_2$ or mixed $CO_2$+CO atmosphere that bend ductility can be achieved in a similar fashion to that achieved in processing in inert gas.

TABLE 12

| Bend Testing Results | | | |
|---|---|---|---|
| Melt-Spinning Parameter | Density [g/cm$^3$] | Thickness [μm] | Bend Ability Type |
| 61 | 7.650 | 34-36 | 4 |
| 62 | 7.667 | 42-44 | 4 |
| 73 | 7.648 | 26-30 | 4 |
| 74 | 7.173 | 41-44 | 4 |

The mechanical properties of metallic ribbons were obtained at room temperature using microscale tensile testing. The testing was carried out in a commercial tensile stage made by Fullam which was monitored and controlled by a MTEST Windows software program. The deformation was applied by a stepping motor through the gripping system while the load was measured by a load cell that was connected to the end of one gripping jaw. Displacement was obtained using a Linear Variable Differential Transformer (LVDT) which was attached to the two gripping jaws to measure the change of gage length. Before testing, the thickness and width of a ribbon were carefully measured for at least three times at different locations in the gage length. The average values were then recorded as gage thickness and width, and used as input parameters for subsequent stress and strain calculation. All tests were performed under displacement control, with a strain rate of ~0.001 $s^{-1}$.

In Table 13, a summary of the tensile test results including gage dimensions, elongation, breaking load, yield stress, ultimate strength and Young's Modulus are shown for the alloy after processing in different atmospheres. Note that each distinct sample was measured in triplicate since occasional macrodefects arising from the melt-spinning process can lead to localized stresses reducing properties. As can be seen the total elongation values vary from 1.55 to 3.42% with high tensile strength values from 1.64 to 3.30 GPa. Young's Modulus was found to vary from 119.2 to 193.7 GPa. Note that the results shown in Table 13 have been adjusted for machine compliance and geometric cross sectional area. The results show that when processing either in the $CO_2$ or mixed $CO_2$+CO atmosphere that the tensile properties were in comparable ranges to that achieved in processing in inert gas.

TABLE 13

| Tensile Property of Fibers Produced in Different Atmospheres | | | | | | | | |
|---|---|---|---|---|---|---|---|---|
| Melt-Spinning | Gage Dimensions (mm) | | | Elong. | Break Load | Strength (GPa) | | Young's Modulus |
| Parameter | W | T | L | (%) | (N) | Yield | UTS | (GPa) |
| MS61 | 1.487 | 0.036 | 9.00 | 1.55 | 143.6 | 2.42 | 2.82 | 139.3 |
| | 1.424 | 0.034 | 9.00 | 3.39 | 151.9 | 1.64 | 3.30 | 153.1 |
| | 1.461 | 0.034 | 9.00 | 3.02 | 143.5 | 1.73 | 3.03 | 193.7 |
| MS62 | 1.36 | 0.044 | 9.00 | 3.42 | 135.7 | 1.37 | 2.38 | 157.6 |
| | 1.35 | 0.042 | 9.00 | 2.97 | 137.5 | 1.07 | 2.46 | 119.2 |
| | 1.36 | 0.042 | 9.00 | 3.06 | 138.2 | 1.07 | 2.61 | 153.4 |
| MS73 | 2.033 | 0.029 | 9.00 | 2.40 | 97.9 | 1.22 | 1.75 | 121.3 |
| | 1.763 | 0.026 | 9.00 | 2.30 | 93.5 | 1.39 | 2.14 | 145.3 |
| | 1.620 | 0.030 | 9.00 | 1.62 | 76.0 | 1.00 | 1.64 | 175.8 |
| MS74 | 1.40 | 0.043 | 9.00 | 3.20 | 153.4 | 1.05 | 2.71 | 167.2 |
| | 1.41 | 0.043 | 9.00 | 3.20 | 147.4 | 1.04 | 2.59 | 159.8 |
| | 1.40 | 0.043 | 9.00 | 2.80 | 146.1 | 1.40 | 2.59 | 183.4 |

Case Example #3

Using high purity elements, 15 g alloy feedstock of alloy 5 was weighed out according to the atomic ratios provided in Table 1. The feedstock material was then placed into the copper hearth of an arc-melting system. The feedstock was arc-melted into an ingot using high purity argon as a shielding gas. The ingots were flipped several times and remelted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were processed by melt spinning in full and partial (⅓) atmosphere of $CO_2$ under process conditions shown in Table 14.

TABLE 14

| Process Parameter List | | | | | | | |
|---|---|---|---|---|---|---|---|
| MS | Chamber gas | Pressure in chamber [mbar] | Pressure in ballast [torr] | Wheel Speed [m/s] | Crucible-chill gap [mm] | Ejection Pressure [mbar] | Ejection Temp. [° C.] |
| 9 | $CO_2$ | 1036 | 855 | 15 | 5 | 140 | 1250 |
| 17 | $CO_2$ | 340 | 465 | 15 | 5 | 140 | 1250 |

Thermal analysis was performed on the as-solidified ribbons using a Perkin Elmer DTA-7 system with the DSC-7 option. Differential thermal analysis (DTA) and differential scanning calorimetry (DSC) was performed at a heating rate of 10° C./minute with samples protected from oxidation through the use of flowing ultrahigh purity argon. In Table 15, the DSC data related to the glass to crystalline transformation is shown for the alloys that have been melt-spun using the various melt-spinning process parameters. Both samples were found to contain a significant fraction of glass of 15% or greater by volume. The glass to crystalline transformation occurs in one stage in the range of temperature from 485 to 495.2° C. and with similar enthalpies of transformation.

TABLE 15

| DTA Data | | | | |
|---|---|---|---|---|
| Melt Spinning Parameter | Glass Present | Peak #1 Onset [° C.] | Peak #1 Temp [° C.] | Peak #1 −ΔH [J/g] |
| 9 | Yes | 485.1 | 491.4 | 42.31 |
| 17 | Yes | 486.5 | 495.2 | 43.15 |

The ability of the ribbons to bend completely flat may indicate a ductile condition whereby relatively high strain can be obtained but not measured by traditional bend testing. When the ribbons are folded completely around themselves, they may experience strain which can be as high as 119.8% as derived from complex mechanics. In practice, the strain may be in the range of ~57% to ~97% strain in the tension side of the ribbon. In Table 16, a summary of the 180° bending results including the specific behavior type are shown for the studied alloys and all were found to exhibit Type 4 bending behavior which means that the samples were bendable on both sides, indicating a ductile sample was achieved.

TABLE 16

| Bend Testing Results | | | |
|---|---|---|---|
| Melt-Spinning Parameter | Density [g/cm$^3$] | Thickness [μm] | Bend Ability Type |
| 9 | 7.695 | 45-55 | 4 |
| 17 | 7.691 | 51-57 | 4 |

The mechanical properties of metallic ribbons were obtained at room temperature using microscale tensile testing. The testing was carried out in a commercial tensile stage made by Fullam which was monitored and controlled by a MTEST Windows software program. The deformation was applied by a stepping motor through the gripping system while the load was measured by a load cell that was connected to the end of one gripping jaw. Displacement was obtained using a Linear Variable Differential Transformer (LVDT) which was attached to the two gripping jaws to measure the change of gage length. Before testing, the thickness and width of a ribbon were carefully measured for at least three times at different locations in the gage length. The average values were then recorded as gage thickness and width, and used as input parameters for subsequent stress and strain calculation. All tests were performed under displacement control, with a strain rate of ~0.001 $s^{-1}$.

In Table 17, a summary of the tensile test results including gage dimensions, elongation, breaking load, yield stress, ultimate strength and Young's Modulus are shown for both alloys after processing in $CO_2$ with different pressure in the chamber. Note that each distinct sample was measured in triplicate since occasional macrodefects arising from the melt-spinning process can lead to localized stresses reducing properties. As can be seen the total elongation values are vary from 2.89 to 3.89% with high tensile strength values from 2.97 to 3.30 GPa for the ribbons produced in full atmosphere of $CO_2$. Young's Modulus was found to vary from 145.9 to 158.8 GPa. For ribbons produced in ⅓ atmosphere of $CO_2$, the total elongation values vary from 2.22 to 4.00% with tensile strength values from 1.55 to 2.80 GPa. Young's Modulus was found to vary from 130.5 to 162.7 GPa. Note that the results shown in Table 17 have been adjusted for machine compliance and geometric cross sectional area.

TABLE 17

Tensile Property of Fibers Produced in $CO_2$ at Different Pressure

| Melt-Spinning | Gage Dimensions (mm) | | | Elong. | Break Load | Strength (GPa) | | Young's Modulus |
|---|---|---|---|---|---|---|---|---|
| Parameter | W | T | L | (%) | (N) | Yield | UTS | (GPa) |
| MS9 | 1.19 | 0.051 | 9.00 | 2.89 | 159.5 | 2.16 | 3.07 | 158.8 |
| | 1.20 | 0.052 | 9.00 | 3.67 | 176.7 | 1.41 | 3.30 | 145.9 |
| | 1.17 | 0.053 | 9.00 | 3.89 | 157.8 | 1.88 | 2.97 | 148.5 |
| MS17 | 1.49 | 0.06 | 9.00 | 2.22 | 134.34 | 1.02 | 1.55 | 158.5 |
| | 1.45 | 0.06 | 9.00 | 4.00 | 234.02 | 1.23 | 2.78 | 130.5 |
| | 1.45 | 0.06 | 9.00 | 3.44 | 235.57 | 1.01 | 2.80 | 162.7 |

Case Example #4

Using commercial purity elements, a 15 g alloy feedstock of alloy 14 was weighed out according to the atomic ratios provided in Table 1. The feedstock material was then placed into the copper hearth of an arc-melting system. The feedstock was arc-melted into an ingot using high purity argon as a shielding gas. The ingot was flipped several times and remelted to ensure composition homogeneity. After mixing, the ingots were then cast in the form of a finger approximately 12 mm wide by 30 mm long and 8 mm thick. The resulting fingers were then placed in a melt-spinning chamber in a quartz crucible with a bottom hole diameter of ~0.81 mm. The ingots were melt and spun in air or $CO_2$ at a the same pressure of ⅓ atm., using RF induction and then ejected onto a 245 mm diameter copper wheel which was traveling at a tangential velocity of 25 m/s.

Figure 2:
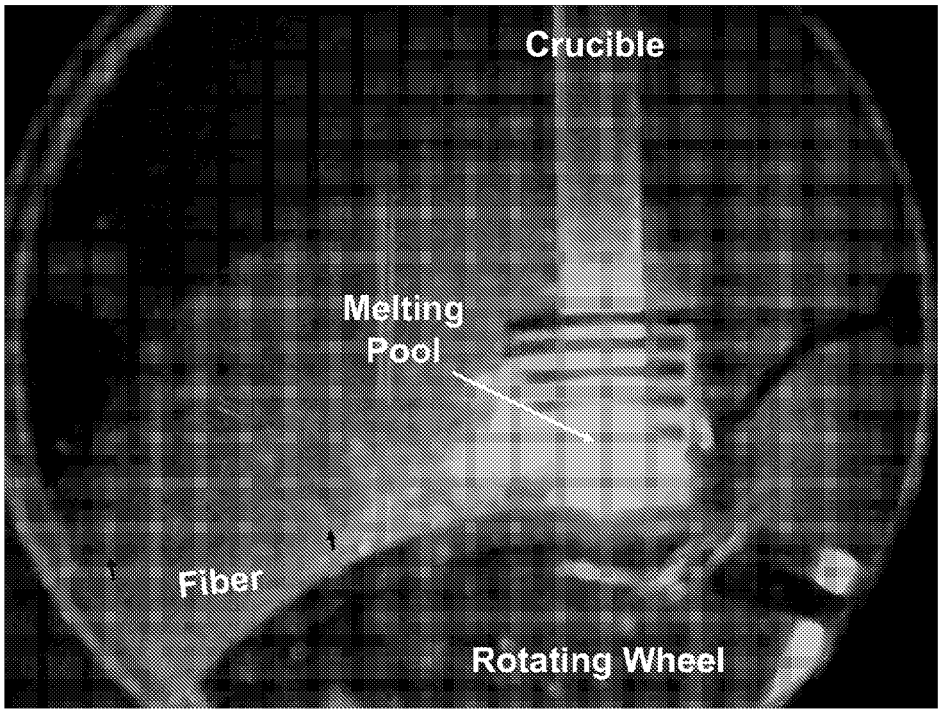
FIG. 2 illustrates an image frame extracted from a video that records the melt-spinning process carried out in $CO_2$ at one third atmosphere pressure.

To investigate the effect of processing atmosphere on the temperature of the ribbons that were spun off the rotating cooling copper wheel, the melt-spinning, carried out in $CO_2$ and air, were recorded using a digital video recorder. In both processing atmospheres, continuous fibers were formed resulting from a stable melt ejection and continuous flowing stream. However, the fibers spun off from the copper wheel have different colors that were dependent on the processing gas environments. As shown in FIG. 1, when processed in air the fibers were glowing red (i.e. ~>800° C.), as indicated by the two small arrows. In contrast, the fibers processed in $CO_2$ were at much lower temperature (i.e. ~<800° C.) so as not to be glowing, as indicated by the two arrows in FIG. 2. Thus, the results show that relatively better coupling was achieved when using the $CO_2$ atmosphere than using an air atmosphere. Better coupling means that more heat transfer was occurring to the copper chill wheel surface in the $CO_2$ atmosphere. As a result, the ribbons appeared to be cooled down to lower temperatures in $CO_2$ than in air after they are spun off the copper wheel.

Case Example #5

Using high purity elements, 15 g alloy feedstock of alloy 13 was weighed out according to the atomic ratios provided in Table 1. The feedstock material was then placed into the copper hearth of an arc-melting system. The feedstock was arc-melted into an ingot using high purity argon as a shielding gas. The ingots were flipped several times and remelted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were processed under process conditions shown in Table 18.

Both ribbons produced in $CO_2$ and in air were tested in tension at room temperature using microscale tensile testing. The testing was carried out in a commercial tensile stage made by Fullam which was monitored and controlled by a MTEST Windows software program. The deformation was applied by a stepping motor through the gripping system while the load was measured by a load cell that was connected to the end of one gripping jaw. Displacement was obtained using a LVDT which was attached to the two gripping jaws to measure the change of gage length. Before testing, the thickness and width of a ribbon were carefully measured for at least three times at different locations in the gage length. The average values were then recorded as gage thickness and width, and used as input parameters for subsequent stress and strain calculation. All tests were performed under displacement control, with a strain rate of ~0.001 $s^{-1}$. Gage length of the samples was 40 mm. Both samples were tested to failure. In Table 19, a summary of the tensile test results including gage dimensions, elongation, breaking load, yield stress, ultimate strength and Young's Modulus are shown for the alloy after processing in different atmospheres. Note that the results shown in Table 19 have been adjusted for machine compliance and geometric cross sectional area.

TABLE 18

Process Parameter List

| MS | Chamber gas | Pressure in chamber [mbar] | Pressure in ballast [torr] | Wheel Speed [m/s] | Crucible-chill gap [mm] | Ejection Pressure [mbar] | Ejection Temperature [° C.] |
|---|---|---|---|---|---|---|---|
| 45 | Air | 340 | 465 | 25 | 5 | 280 | 1250 |
| 62 | $CO_2$ | 340 | 465 | 25 | 5 | 280 | 1250 |

TABLE 19

Tensile Property of Fibers Produced in Different Atmospheres

| Melt-Spinning | Gage Dimensions (mm) | | | Elong. | Break Load | Strength (GPa) | | Young's Modulus |
|---|---|---|---|---|---|---|---|---|
| Parameter | W | T | L | (%) | (N) | Yield | UTS | (GPa) |
| MS45 | 1.60 | 0.031 | 40.00 | 2.20 | 145.7 | 1.43 | 3.09 | 187.9 |
| MS62 | 1.50 | 0.034 | 40.00 | 2.34 | 151.3 | 1.94 | 3.10 | 165.6 |

Figure 3A:
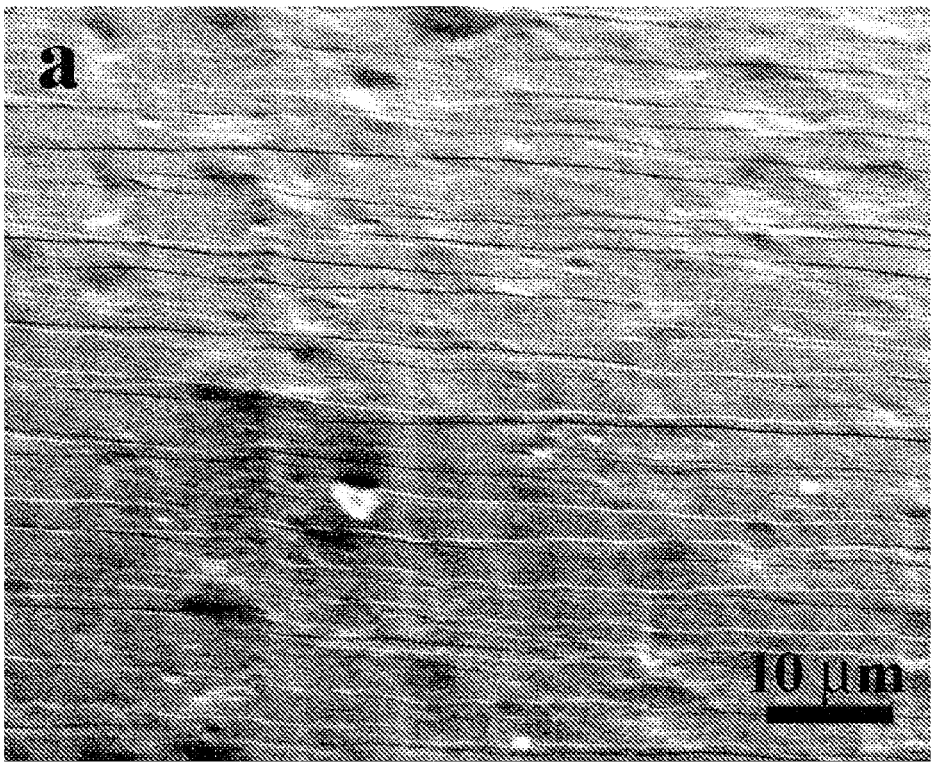
FIGS. 3*a* and 3*b* illustrate SEM secondary electron micrographs of deformed alloy 14 ribbons processed in air (FIG. 3*a*) and in $CO_2$ (FIG. 3*b*).
Figure 3B:
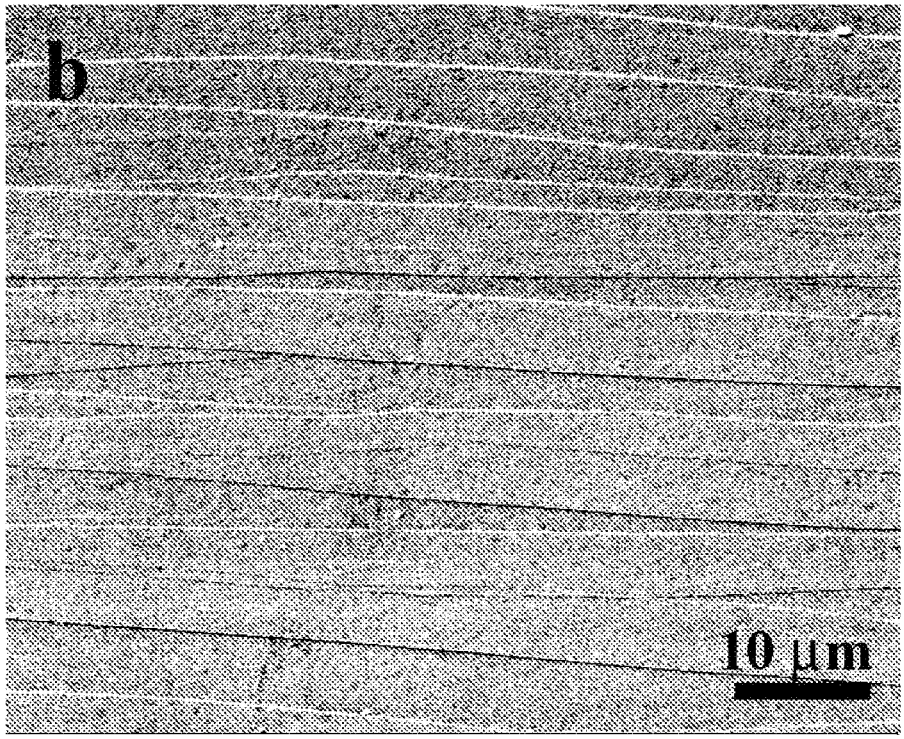

The surfaces of both deformed ribbons were examined by scanning electron microscopy (SEM) using an EV0-MA10 scanning electron microscope manufactured by Carl Zeiss SMT Inc. Melt spun ribbons were mounted in a standard metallographic mount using a metallography binder clip. Typical operating conditions were electron beam energy of 17.5 kV, filament current of 2.4 A, and spot size setting of 800. SEM secondary electron micrographs of the surface of deformed alloy 14 ribbons produced in air and in carbon dioxide are shown in FIGS. 3*a* and 3*b*, respectively. Both samples have demonstrated deformation by multiple shear banding and exhibit both induced shear bands blunting (ISBB) by the SGMM structure and induced shear band arresting (ISBA) by existing shear bands. Also, note that the ribbons produced in air (illustrated in FIG. 3*a*) appear to have a rougher, non-uniform surface as compared to those produced in $CO_2$ (illustrated in FIG. 3*b*). Smoother ribbons are an advantage for many applications since they contain less surface defects and would be expected to exhibit more uniform properties.

Case Example #6

Using commercial purity elements, a 15 g alloy feedstock of alloy 13 was weighed out according to the atomic ratios provided in Table 1. The feedstock material was then placed into the copper hearth of an arc-melting system. The feedstock was arc-melted into an ingot using high purity argon as a shielding gas. The ingot was flipped several times and remelted to ensure composition homogeneity. After mixing, the ingots were then cast in the form of a finger approximately 12 mm wide by 30 mm long and 8 mm thick. The resulting fingers were then placed in a melt-spinning chamber in a quartz crucible with a bottom hole diameter of ~0.81 mm. The ingots were melt spun in $CO_2$ at a pressure of ⅓ atm., using RF induction and then ejected onto a 245 mm diameter copper wheel which was traveling at a tangential velocity of 25 m/s.

TEM samples were prepared from fiber segments that demonstrated ductile bending behavior. Since the fibers were produced using single cooling copper wheel, it is possible that there existed cooling rate gradients across fiber thickness, leading to varying structure across fiber thickness. To fully characterize the nanostructures in the fibers processed in $CO_2$ cross-sectional TEM samples were prepared using a newly-developed process. The selected fiber segments of ~5 mm long were mounted in a 5-minute epoxy. After completely curing overnight, the fiber segments, together with the epoxy matrix, were mechanically ground using SiC sand paper, followed by polishing to remove one half of the fiber width (~0.75 mm). Then the fiber segments were flipped over and remounted into the epoxy. The same grinding and polishing processes were carried out, until the TEM cross-sectional foils are less than 10 μm thin. Thin areas for observation were then produced by ion milling. TEM examination was carried out in a JEM2100 HRTEM.

Figure 4A:
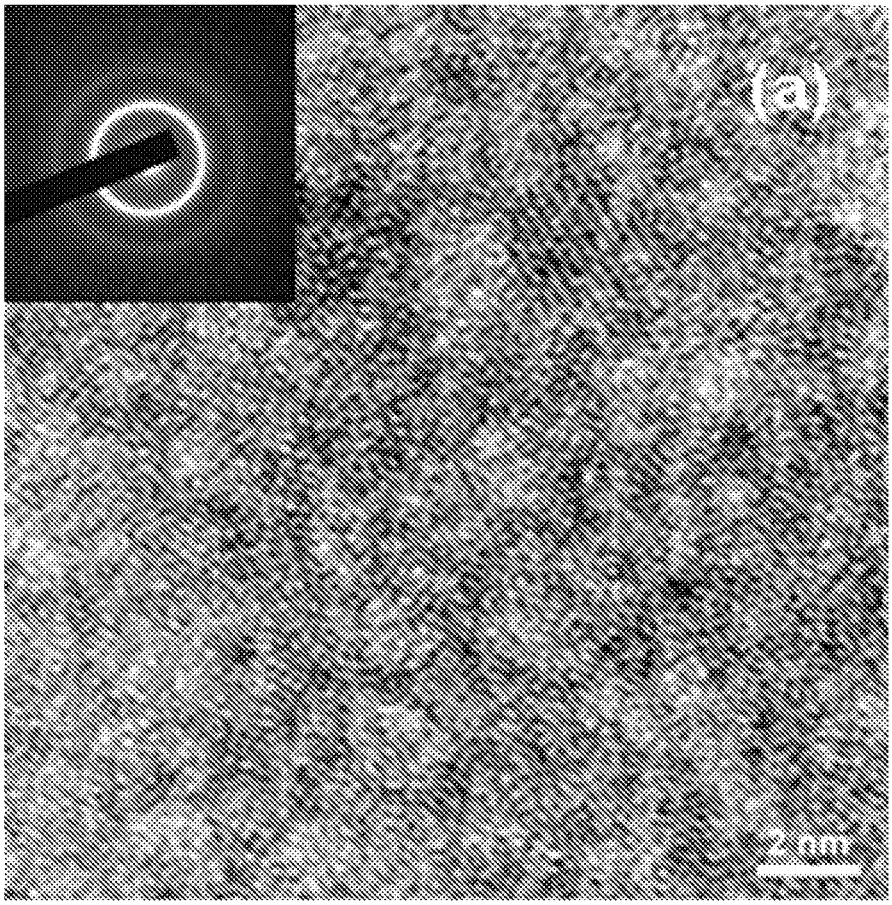
FIG. 4*a* through 4*c* illustrate a comparison of the structures of alloy 13 fibers produced in $CO_2$; including the wheel surface (FIG. 4*a*), center region (FIG. 4*b*) and free surface (FIG. 4*c*).
Figure 4B:
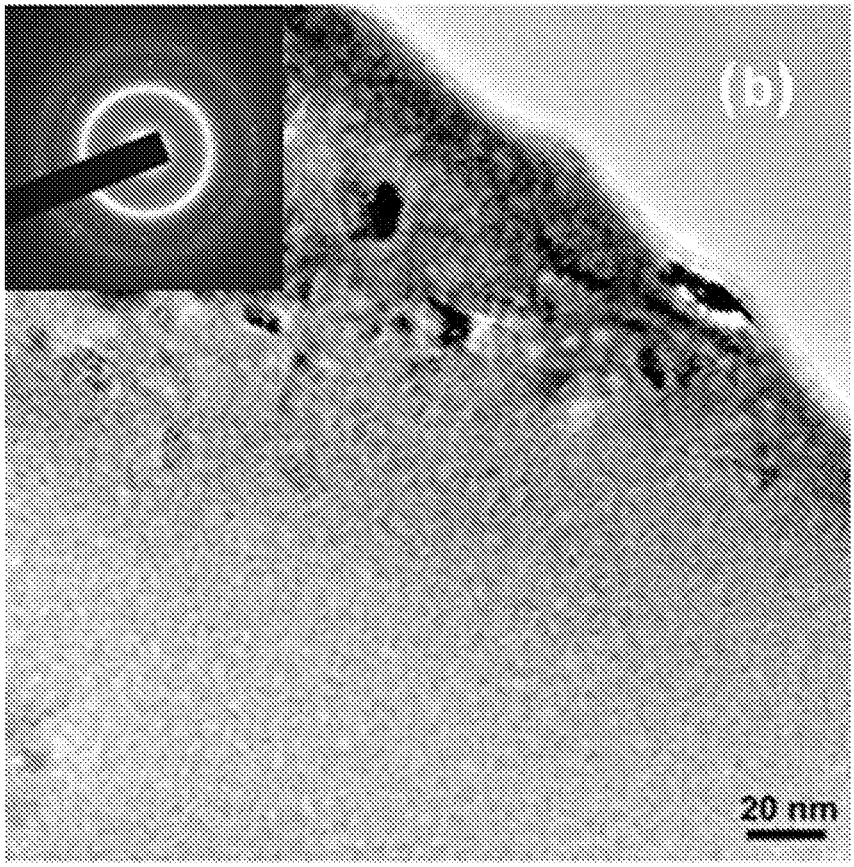
Figure 4C:
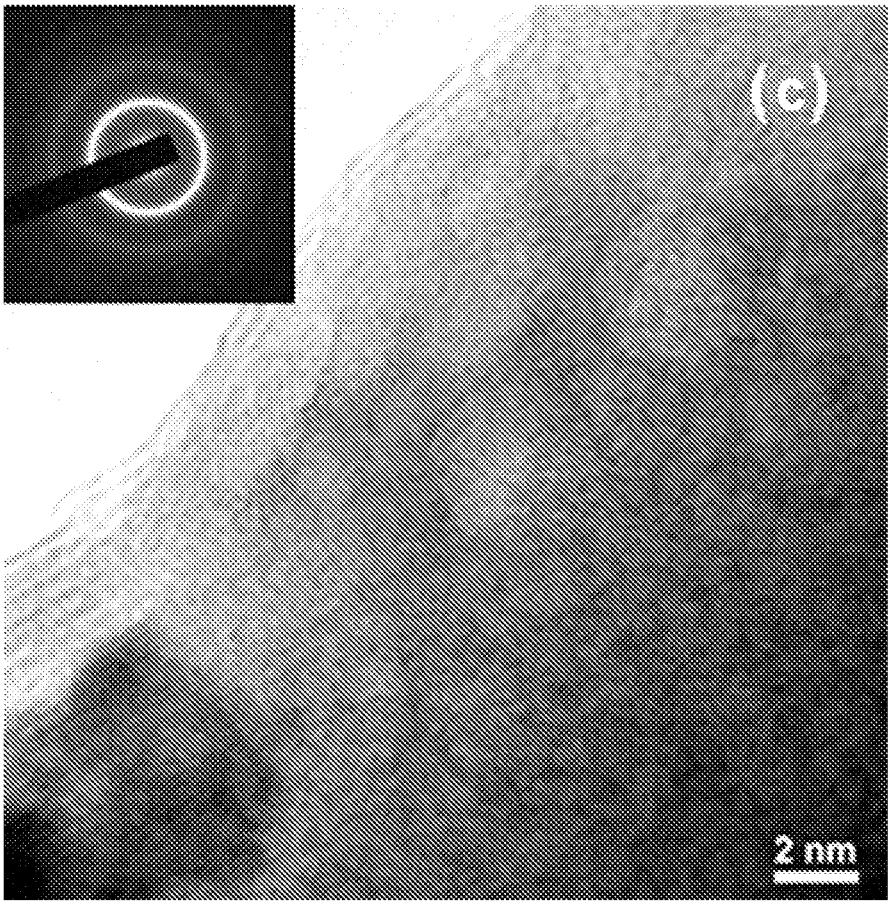

The TEM results are presented in FIGS. 4*a* through 4*c* and represent the structures found in the region close to the wheel-side surface (4*a*), the center region (4*b*), and the free-side surface (4*c*). The structure in the region close to the wheel-side surface is primarily amorphous, with very few 2-3 nm particles showing ordered structure (FIG. 4*a*). In the region close to the center of the fiber are nanocrystalline regions surrounded by glass matrix (FIG. 4*b*). Each individual nanocrystalline region contains numerous nanocrystals of tens nanometers in sizes that are distributed in the glass matrix and may be considered a SGMM structure. The selected area electron diffraction pattern (inset of FIG. 4*b*) shows the nanocrystals are a mixture of BCC and FCC structures. In the regions close to the free side is primarily metallic glass containing a few nanocrystals (FIG. 4*c*), that are generally tens nanometers in sizes. There are more nanocrystals in this side than in the region close to the wheel side. The different nanostructures observed in the three regions are consistent with the changing cooling rates across the fiber thickness but all examples clearly show various stages of spinodal decomposition resulting in nanoscale precipitates in a metallic glass matrix.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A method of forming an iron based glass forming alloy, comprising:

providing a feedstock of an iron based glass forming alloy, wherein said iron based glass forming alloy comprises 40.5 to 65.5 atomic percent iron, 13.0 to 17.5 atomic percent nickel, 2.0 to 21.5 atomic percent cobalt, 11.5 to 17.0 atomic percent boron, optionally 4.0 to 8.0 atomic percent carbon, optionally 0.3 to 4.5 atomic percent silicon, and optionally 2.0 to 20.5 atomic percent chromium;

melting said feedstock;

casting said feedstock into an elongated body in an environment comprising an inert gas and 50% or more of a gas selected from carbon dioxide, carbon monoxide or mixtures thereof, wherein said gasses are present at a pressure of 0.1 atm to 0.67 atm, and said iron based glass forming alloy after casting exhibits an ultimate tensile strength in the range of 1.55 GPa to 3.30 GPa and a Young's Modulus in the range of 103.7 GPa to 230.7 GPa.

2. The method of claim 1, wherein a spinodal glass forming matrix is developed upon casting.

3. The method of claim 2, wherein said iron based glass forming alloy after casting exhibits one or more glass to crystalline transformations in the range of 400° C. to 552° C.

4. The method of claim 1, wherein said iron based glass forming alloy after casting exhibits an elongation in the range of 2.10% to 4.23% at a strain rate of 0.001 $s^{-1}$.

5. The method of claim 1, wherein casting is selected from one or more of the following: melt spinning, jet casting, hyperquenching, planar flow casting and twin roll casting.

6. The method of claim 1, wherein said feedstock is cast into a ribbon.

7. The method of claim 1, wherein said feedstock is cast into a wire.

8. The method of claim 1, wherein a mixture of carbon monoxide and carbon dioxide are present and carbon monoxide is present in the range of 1% to 99% of the total amount of the mixture and carbon dioxide is present in the range of 99% to 1% of the total amount of the mixture.

9. The method of claim 1, wherein said elongated body has a thickness in the range of 0.1 mm to 2,000 mm.

10. The method of claim 1, wherein said elongated body does not include nucleation sites reducing the glass volume to less than 15%.

11. A method of forming an iron based glass forming alloy, comprising:

providing a feedstock of an iron based glass forming alloy, wherein said iron based glass forming alloy comprises 40.5 to 65.5 atomic percent iron, 13.0 to 17.5 atomic percent nickel, 2.0 to 21.5 atomic percent cobalt, 11.5 to 17.0 atomic percent boron, 4.0 to 8.0 atomic percent carbon, optionally 0.3 to 4.5 atomic percent silicon, and optionally 2.0 to 20.5 atomic percent chromium;

melting said feedstock;

casting said feedstock into an elongated body in an environment comprising a mixture of carbon dioxide and carbon monoxide.

12. The method of claim 11, wherein a spinodal glass forming matrix is developed upon casting.

13. The method of claim 11, wherein said iron based glass forming alloy after casting exhibits one or more glass to crystalline transformations in the range of 400° C. to 552° C.

14. The method of claim 11, wherein said iron based glass forming alloy after casting exhibits an elongation in the range of 2.10% to 4.23% at a strain rate of 0.001 $s^{-1}$.

15. The method of claim 11, wherein said iron based glass forming alloy after casting exhibits an ultimate tensile strength in the range of 1.55 GPa to 3.30 GPa and a Young's Modulus in the range of 103.7 GPa to 230.7 GPa.

16. The method of claim 11, wherein a mixture of carbon monoxide and carbon dioxide are present and said carbon monoxide is present at levels of greater than 75% by volume.

17. The method of claim 11, wherein said gas is at a pressure of 0.1 atm. to 1 atm.

18. The method of claim 11, wherein said elongated body does not include nucleation sites reducing the glass volume to less than 15%.

19. The method of claim 11, wherein said environment further comprises an inert gas.

* * * * *

UNITED STATES PATENT AND TRADEMARK OFFICE

CERTIFICATE OF CORRECTION

PATENT NO. : 8,807,197 B2
APPLICATION NO. : 13/019041
DATED : August 19, 2014
INVENTOR(S) : Branagan et al.

It is certified that error appears in the above-identified patent and that said Letters Patent is hereby corrected as shown below:

In the Claims

Column 21, line 31, claim 3, delete "claim 2," and
insert -- claim 1, --, therefor.

Signed and Sealed this
Twenty-fifth Day of November, 2014

Michelle K. Lee

Michelle K. Lee
*Deputy Director of the United States Patent and Trademark Office*